US006109536A

United States Patent [19]

English

[11] Patent Number: 6,109,536

[45] Date of Patent: Aug. 29, 2000

[54] FUEL INJECTION SYSTEM WITH CYCLIC INTERMITTENT SPRAY FROM NOZZLE

[75] Inventor: Paul R. English, Washington, Ill.

[73] Assignee: Caterpillar Inc., Peoria, Ill.

[21] Appl. No.: 09/175,676

[22] Filed: Oct. 20, 1998

Related U.S. Application Data

[60] Provisional application No. 60/085,430, May 14, 1998.

[51] Int. Cl.[7] ..... F02M 45/00

[52] U.S. Cl. ..... 239/5; 239/533.5

[58] Field of Search ..... 239/533.8, 92, 239/94, 124, 533.4, 533.5, 75, 5

[56] References Cited

U.S. PATENT DOCUMENTS

| | | | |
|---|---|---|---|
| 3,216,407 | 11/1965 | Eyzat | 123/32 |
| 3,227,172 | 1/1966 | Sims et al. | 137/116.3 |
| 3,394,891 | 7/1968 | Voit | 239/533.5 |
| 3,469,793 | 9/1969 | Guerfler | 239/533.5 |
| 3,627,208 | 12/1971 | Scott | 239/533.5 |
| 3,677,141 | 7/1972 | Lagerqvist et al. | 91/394 |
| 3,759,239 | 9/1973 | Regneault et al. | 123/32 G |
| 3,896,856 | 7/1975 | Schumacher et al. | 137/625.65 |
| 4,173,208 | 11/1979 | Fenne et al. | 123/139 |
| 4,201,160 | 5/1980 | Fenne | 123/32 G |
| 4,289,098 | 9/1981 | Norberg et al. | 123/299 |
| 4,392,466 | 7/1983 | Mowbray et al. | 123/299 |
| 4,407,251 | 10/1983 | Nakanishi | 123/427 |
| 4,669,659 | 6/1987 | Leblanc et al. | 239/124 |
| 4,711,209 | 12/1987 | Henkel | 123/300 |
| 4,962,887 | 10/1990 | Matsuoke | 239/12 G |
| 5,054,445 | 10/1991 | Henkel et al. | 123/300 |
| 5,072,706 | 12/1991 | Eblen et al. | 123/297 |
| 5,103,785 | 4/1992 | Henkel | 123/299 |
| 5,167,370 | 12/1992 | Henkel | 239/533.8 |
| 5,542,610 | 8/1996 | Augustin | 239/600 |
| 5,626,294 | 5/1997 | McCandless | 239/533.9 |

*Primary Examiner*—Kevin Weldon
*Attorney, Agent, or Firm*—Michael McNeil

[57] ABSTRACT

A fuel injection system includes an injector body that defines a nozzle outlet connected to a nozzle supply passage having a flow restriction. A source of fuel at a supply pressure is in fluid communication with the nozzle supply passage. A needle valve member is positioned in the injector body and is moveable between an open position in which the nozzle outlet is open, and a closed position in which the nozzle outlet is blocked. The supply pressure is of a magnitude and the flow restriction is of a size that the needle valve member moves cyclically between its closed position and its open position.

17 Claims, 4 Drawing Sheets

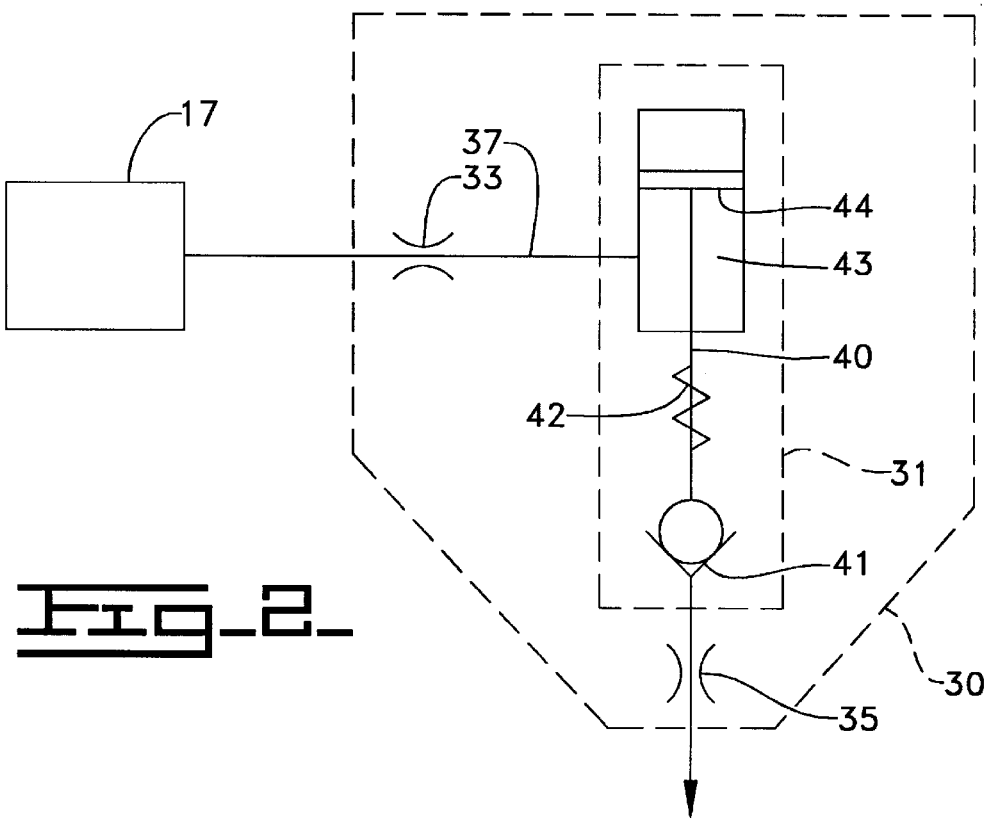
Fig_2_
Fig_3_
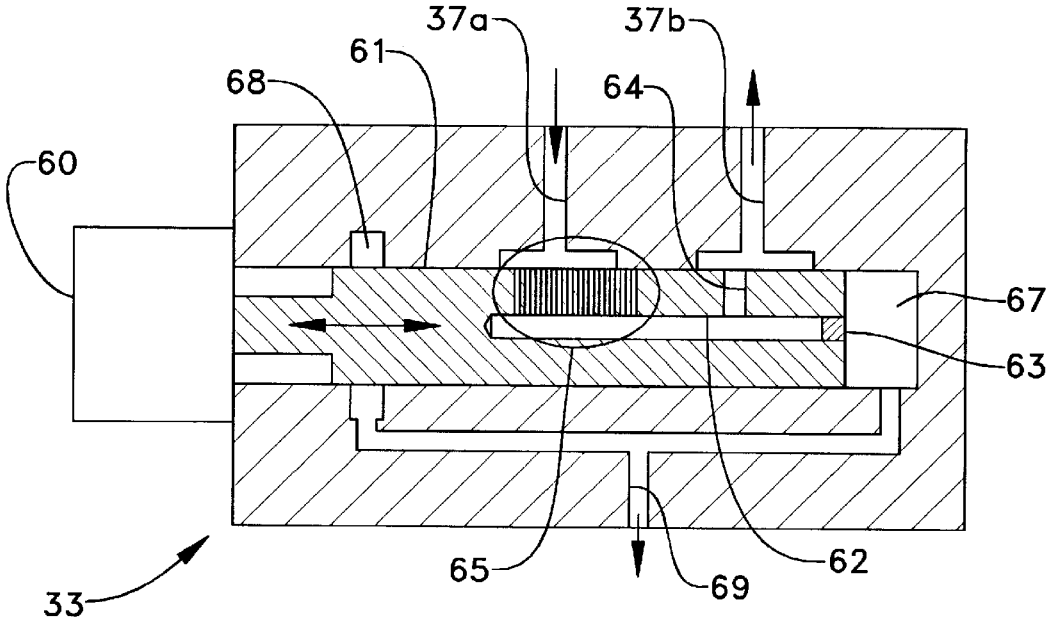

FUEL INJECTION SYSTEM WITH CYCLIC INTERMITTENT SPRAY FROM NOZZLE

RELATION TO OTHER APPLICATION

This application claims priority from pending provisional application No. 60/085,430, filed May 14, 1998, with the same title.

TECHNICAL FIELD

The present invention relates generally to fuel injection systems, and more particularly to a fuel injection system with the ability to spray fuel from a nozzle into a combustion space in a cyclic intermittent manner.

BACKGROUND ART

In most fuel injection systems, fuel is sprayed into a combustion space through one or more relatively tiny nozzle orifices at a relatively high pressure. A needle check valve normally blocks the nozzle orifices, but is capable of moving to an open position when fuel pressure is above a valve opening pressure sufficient to overcome a bias that is acting on the needle valve. In a typical injection sequence, the needle valve member moves to an open position, an amount of fuel is injected into the engine cylinder, and the needle valve then closes to end the injection event. In order to increase combustion efficiency, and hence lower the presence of unburned hydrocarbons and NOx in the emissions, engineers are continuously seeking ways to improve the mixing of the fuel with air when the same is sprayed into the engine cylinder. The conventional wisdom has long been that the best mixing of fuel and air occurs when the fuel is atomized. The conventional wisdom with regard to improving atomization has generally been to make the nozzle orifices as small as possible and the fuel pressure as high as possible. However, because of material and machining constraints, nozzle orifices can realistically be made only so small and the fuel can only be pressurized so high.

The present invention is directed to improving combustion efficiency, and hence lowering undesirable emissions, by injecting fuel in a manner different from that of the prior art.

DISCLOSURE OF THE INVENTION

A fuel injection system includes an injector body that defines a nozzle outlet connected to a nozzle supply passage having a flow restriction. A source of fuel at a supply pressure is in fluid communication with the nozzle supply passage. A needle valve member is positioned in the injector body and is moveable between an open position in which the nozzle outlet is open, and a closed position in which the nozzle outlet is blocked. The supply pressure is at a magnitude, and the flow restriction is of a size, that the needle valve member moves cyclically between its closed position and its open position.

In another embodiment, the needle valve member includes a lifting hydraulic surface positioned in the injector body. In addition, a spring, which at least partially defines a valve opening pressure, is operably positioned to bias the needle valve member toward its closed position.

In still another embodiment of the present invention, a fuel injection system includes an injector body that defines a needle control chamber, and a nozzle outlet connected to a nozzle supply passage having a flow restriction. A source of fuel at a supply pressure is in fluid communication with the nozzle supply passage. A needle valve member is positioned in the injector body and is moveable between an open position in which the nozzle outlet is open, and a closed position in which the nozzle outlet is blocked. The needle valve member includes a closing hydraulic surface exposed to fluid pressure in the needle control chamber. A needle control valve is attached to the injector body and is moveable between an on position in which the needle control chamber is open to a low pressure passage, and an off position in which the needle control chamber is open to a source of high pressure. The supply pressure is of a magnitude, and the flow restriction is of a size, that the needle valve member moves cyclically between its closed position and its open position.

BRIEF DESCRIPTION OF THE DRAWINGS

FIG. 2 is a schematic illustration of a nozzle assembly according to one aspect of the present invention.

FIG. 3 is a side sectioned diagrammatic illustration of a flow restriction valve according to one aspect of the present invention.

BEST MODE FOR CARRYING OUT THE INVENTION

Figure 1:
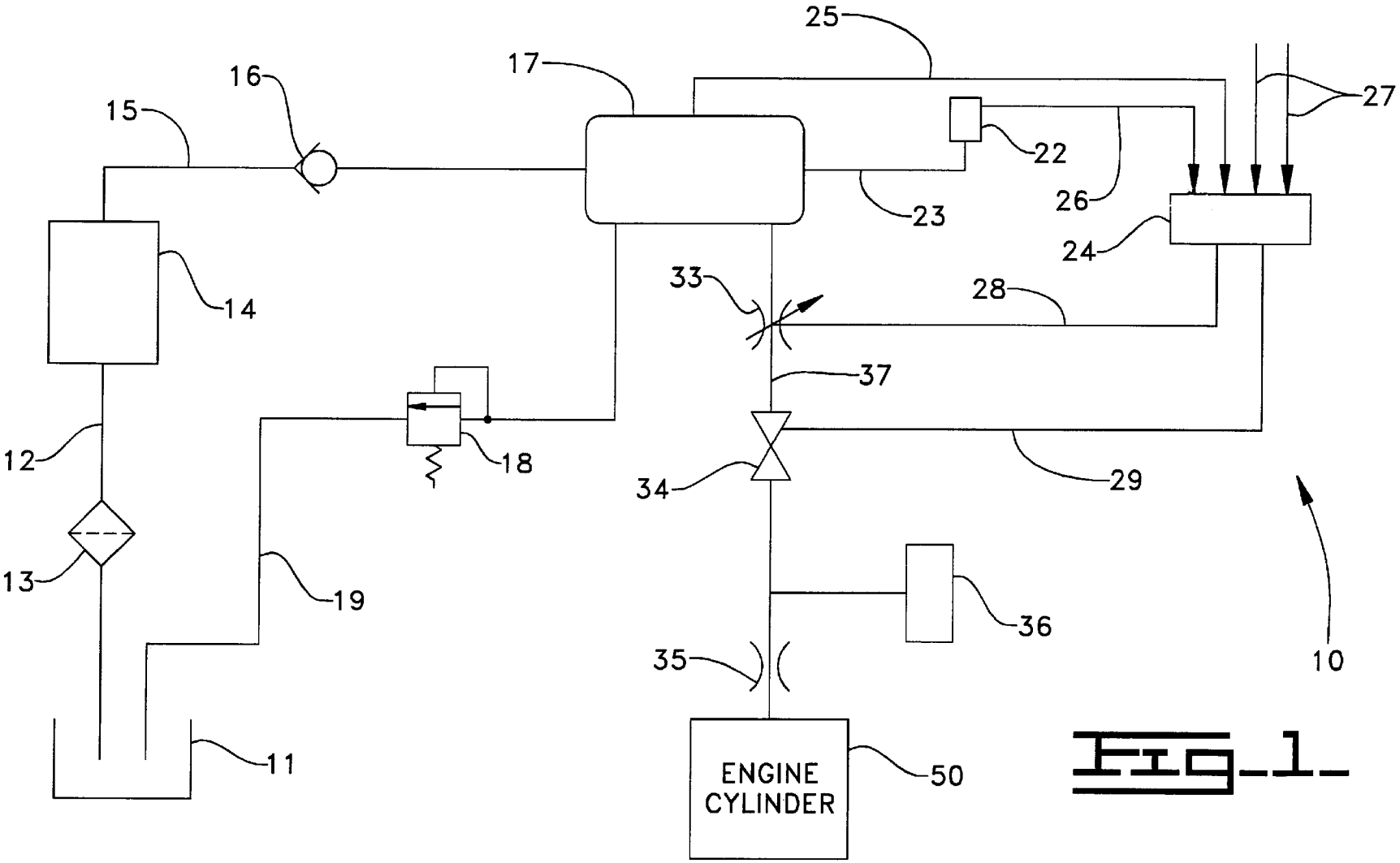
FIG. 1 is a schematic illustration of a fuel injection system according to the present invention.

Referring now to FIG. 1, a fuel injection system 10 injects fuel through a nozzle outlet 35 into an engine cylinder 50. The injection process is controlled by an electronic control module 24 that receives a variety of inputs, including a fuel viscosity sensor input 26, a fuel pressure sensor input 25 and other inputs 27, which are known in the art. A high pressure fuel pump 14 draws low pressure fuel from tank 11, along low pressure fuel supply line 12, and through fuel filters 13. High pressure pump 14 pushes the fuel through high pressure supply line 15, past check valve 16 and into high pressure fuel reservoir 17. A pressure regulating valve 18 maintains the fuel pressure in reservoir 17 at a known supply pressure. Any fuel released by pressure regulating valve 18 is returned to fuel tank 11 via fuel return line 19.

A temperature and viscosity sensor 22 is attached to high pressure fuel reservoir 17 via a connection line 23. Those skilled in the art will appreciate that the temperature and viscosity sensor could be located elsewhere in the system.

A nozzle supply passage 37 extends between high pressure fuel reservoir 17 and nozzle outlet 35. A flow restriction valve 33 is positioned in nozzle supply passage 37. The flow area through flow restriction valve 33 is controlled by electronic control module 24 via a communication control line 28. Injection events are initiated and ended by a needle control valve 34, which is controlled in its operation by electronic control module 24 via a communication control line 29. A hydraulic check damper 36 is positioned to damp the movement of a needle valve member that moves to open and close nozzle outlet 35. Those skilled in the art will appreciate that the order of needle control valve 34 and flow restriction valve 33 could be reversed from the orientation shown in FIG. 1.

Figure 4:
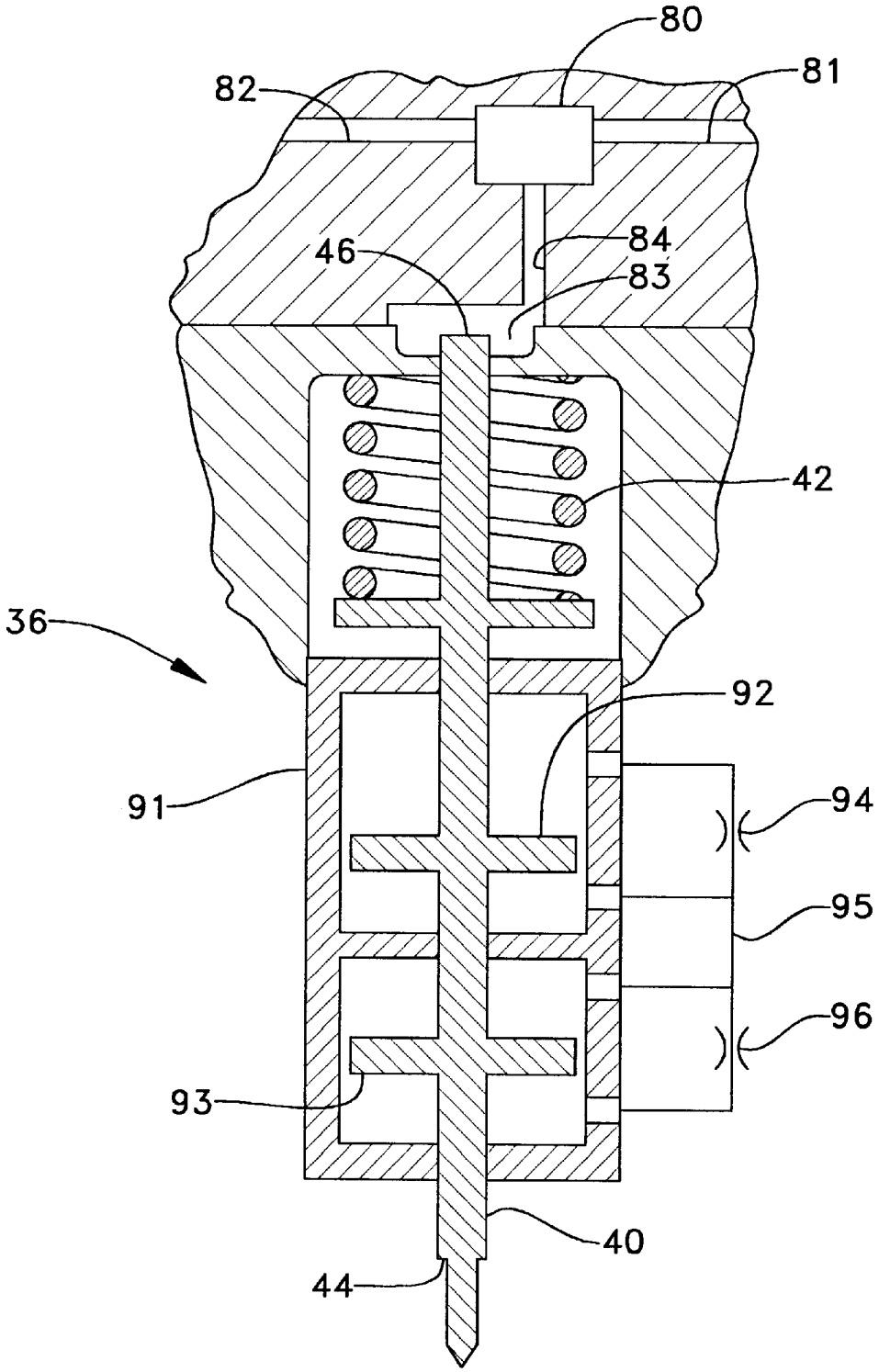
FIG. 4 is a sectioned side diagrammatic view of a hydraulic check damper according to another aspect of the present invention.
Figure 5A:
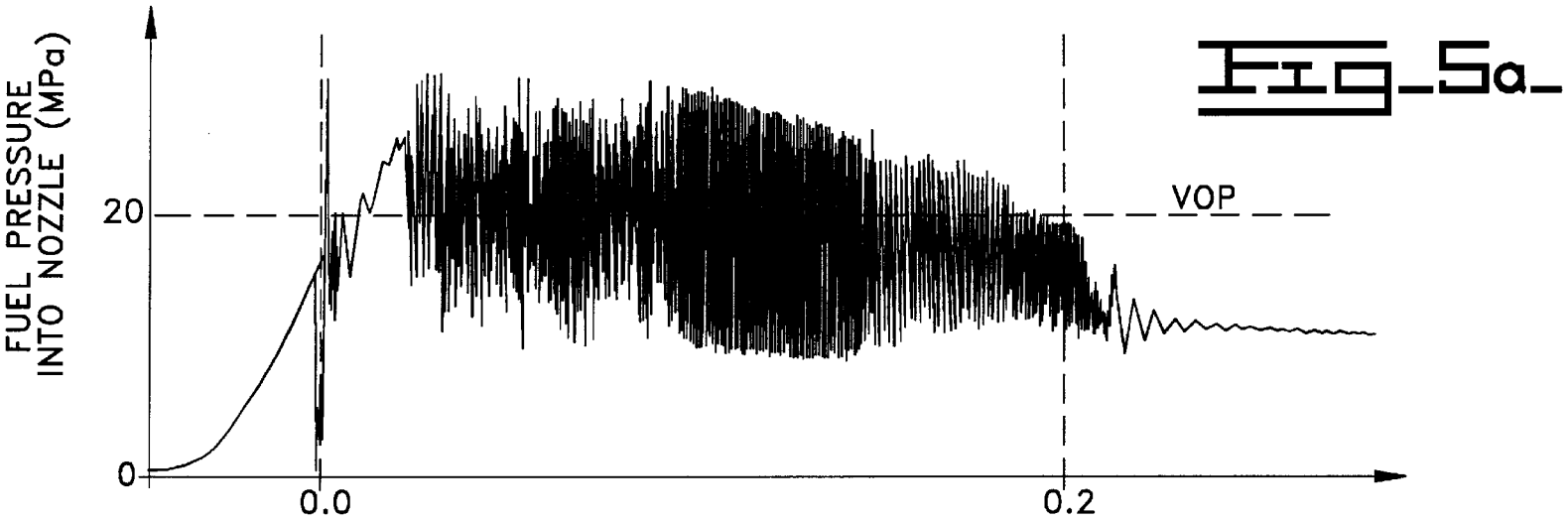
FIGS. 5*a–b* are plots of fuel pressure and injection rate, respectively, versus time, for a single injection cycle according to the present invention.
Figure 5B:
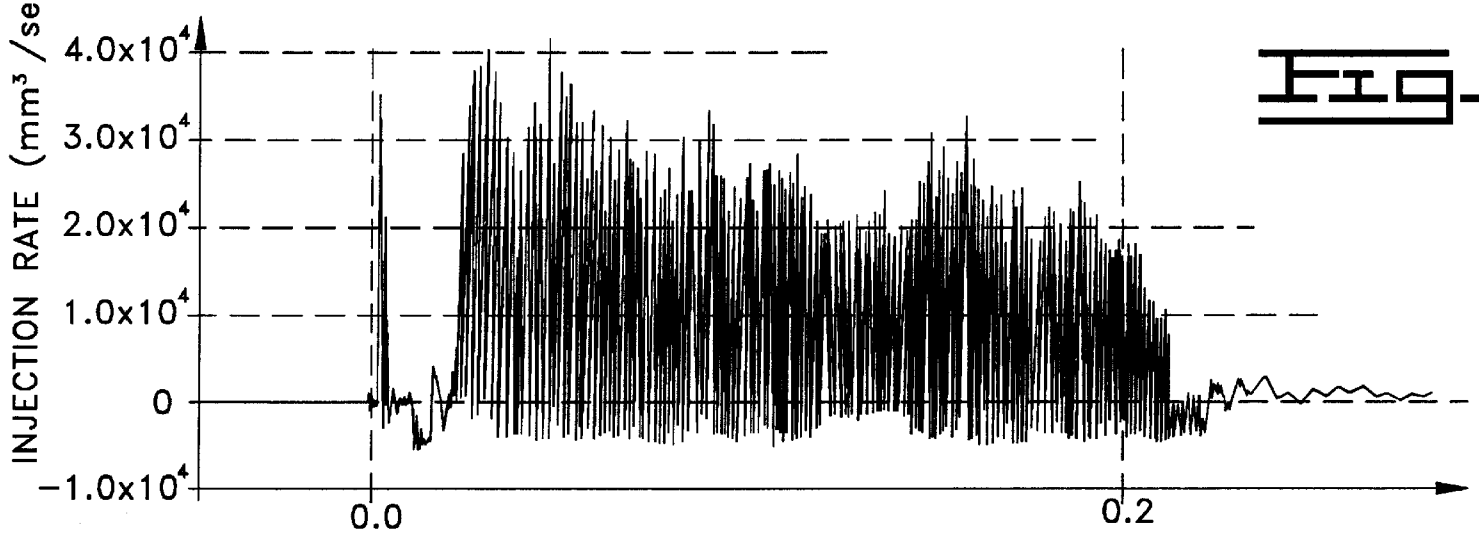

Referring now to FIGS. 2–4, various details of the present invention are illustrated. In a typical fuel injector, nozzle outlet 35 is positioned at one end of an injector body 30. A nozzle assembly 31 is positioned adjacent nozzle outlet 35. Nozzle assembly 31 includes a needle valve member 40 that acts as a needle check valve 41 to open and close nozzle outlet 35. A needle biasing spring 42 normally biases needle valve member 40 downward to its closed position. The needle valve member 40 includes a lifting hydraulic surface 44 that is exposed to fluid pressure in a nozzle chamber 43 that is exposed to the fuel in nozzle supply passage 37.

Referring now to FIG. 3, one version of a flow restriction valve 33 according to the present invention is illustrated. A restriction valve member 61 is attached to a multi-position solenoid 60. Restriction valve member 61 includes a plurality of small diameter vertical restriction passageways 65, an internal passageway 62 and a vertical passageway 64. A plug 63 closes one end of internal passageway 62. All fluid passing from the upstream portion of nozzle supply passage 37*a* to the downstream portion 37*b* must first pass through restriction passages 65, internal passageway 62 and vertical passage 64. Depending upon the amount of current being supplied to multi-position solenoid 60, a different number of vertical restriction passages 65 will be open to upstream nozzle supply passage 37*a*. Thus, by controlling the amount of current supplied to solenoid 60, the flow area through flow restriction valve 33 can be controlled. Any fluid that leaks along the outer surface of valve member 61 into either leak chamber 68 or end chamber 67 is returned for reuse via a low pressure fuel drain 69.

Referring now to FIG. 4, in addition to a lifting hydraulic surface 44, needle valve member 40 preferably includes a closing hydraulic surface 46 that is exposed to fluid pressure in a needle control chamber 83. A needle control valve 80 can be moved to a first position in which control passage 84, which is connected to needle control chamber 83, is open to a high pressure passage 82. Needle control valve 80 can also be moved to a second position in which control passage 84 is closed to high pressure passage 82 but open to a low pressure passage 81.

Lifting hydraulic surface area 44, closing hydraulic surface area 46, the strength of biasing spring 42, the desired supply pressure in high pressure reservoir 17 and the pressure in high pressure passage 82 are all chosen such that needle valve member 40 will remain in its closed position as long as needle control valve 80 opens control passage 84 to high pressure passage 82. When needle control valve 80 moves to its second position to open control passage 84 to low pressure passage 81, needle valve member 40 behaves as a conventional needle check valve, in that it will lift to its open position, due to fuel pressure acting on lifting hydraulic surface 44, when the same overcomes the closing biasing force supplied by spring 42. The pressure at which the needle valve member 40 begins to move is typically referred to as the valve opening pressure.

Since the needle valve member 40 of the present invention moves relatively quickly between its open and closed positions, the present invention contemplates the preferable inclusion of a hydraulic check damper 36. In this embodiment, the hydraulic check damper includes a damper enclosure 91 that is separated into upper and lower chambers that are connected via fluid communication passageways 95 past flow restrictions 94 and 96. The upper and lower chambers of damper enclosure 91 are preferably filled with fuel. Needle valve member 40 includes hilts 92 and 93 that are positioned in the upper and lower chambers, respectively. When needle valve member 40 moves, the fluid displacement around hilts 92 and 93 tends to damp its movement, in a manner well known in the art.

Industrial Applicability

Between injection events, needle valve member 40 is in its closed position because needle control valve 80 connects needle control chamber 83 to high pressure passage 82. Each injection event is initiated by moving needle control valve 80 to connect needle control chamber 83 to low pressure passage 81. The high pressure fuel acting on lifting hydraulic surface 44 causes needle valve member 40 to move to its open position to open nozzle outlet 35. Provided that flow restriction valve 33 is properly positioned, the fuel pressure acting on the lifting hydraulic surface 44 of needle valve member 40 will fluctuate rapidly above and below that valve opening pressure. This causes the needle valve member to rapidly move between its open and closed positions. Each injection event is ended by again opening needle control chamber 83 to high pressure passage 82 to force needle valve member to stay at its closed position to close nozzle outlet 35.

Instead of relying upon ever higher fuel pressures to achieve good atomization to promote mixing of fuel with air in the combustion space within an engine, the present invention seeks to improve combustion efficiency by rapidly opening and closing the needle valve member during each injection event. By rapidly opening and closing the nozzle outlet, fuel is cyclically intermittently sprayed into the combustion space in such a way that better mixing occurs, which results in a more efficient burn. Better burning through better mixing generally produces less particle, NOx and noise emissions. Furthermore, this is can be accomplished at a fuel pressure that is significantly lower (e.g. 90 MPa) than relatively high pressures (e.g. 200 MPa) produced in the typical diesel type fuel injector.

In order to produce the rapid opening and closing of the needle valve member, or check chatter, the supply pressure must be controlled closely relative to the valve opening pressure of the needle valve member. In addition, the area through the flow restriction valve must be controlled relative to the flow area through the nozzle outlet of the fuel injection system. The most intuitive operating point for the present invention is when the supply pressure in the high pressure reservoir is about equal to the valve opening pressure, and the flow area through the flow restriction valve is about equal to the flow area through the nozzle outlet of the injector. Referring to FIGS. 6*a* and 6*b*, when these conditions are present, the fuel pressure downstream from the flow restriction valve cycles rapidly above and below the valve opening pressure for the needle valve member. This in turn causes the needle valve to rapidly open and close causing a large number of very small injections to occur over a relatively brief period of time. The total amount of fuel injected for a single injection event would be the sum of the small amounts of fuel injected with each opening and closing of the needle valve member.

Since the needle valve member moves so rapidly between its open and closed positions, in some versions of the invention it may be necessary to include a hydraulic check damper as illustrated in FIG. 4 to prevent damage to the injector. The presence of a check damper might also serve to effect the frequency at which the check chatter phenomenon occurs. In addition, those skilled in the art will appreciate that the viscosity of the fuel will likewise have a strong effect on the frequency at which check chatter occurs. Depending upon such factors as temperature and the quality of fuel, viscosity can vary on the order of a factor of two or more. In order to better control each injection event, the present invention preferably contemplates the use of a flow restriction valve to adjust the conditions at which the check chattering will occur for a particular fuel supply pressure and viscosity at a given time.

By providing the conditions at which very minute amounts of fuel can be injected in relatively tightly spaced intervals, better mixing of fuel and air can be achieved at lower fuel pressures than that thought possible with conventional fuel injection systems in which the needle valve member only opens and closes once or twice during an injection event. The above description is intended for illustrative purposes only and is not intended to limit the scope of the present invention in any way. Those skilled in the art will appreciate that the various fuel supply pressures and flow areas can be varied significantly and still create the check chattering conditions according to the present invention. Thus, although an example embodiment has been illustrated, the full scope of the present invention is defined in terms of the claims set forth below.

What is claimed is:

1. A fuel injection system comprising:

a injector body defining a nozzle outlet with an outlet flow area connected to a nozzle supply passage having a flow restriction with a restricted flow area about equal to said outlet flow area;

a source of fuel at a supply pressure in fluid communication with said nozzle supply passage;

a needle valve member positioned in said injector body and being movable between an open position in which said nozzle outlet is open, and a closed position in which said nozzle outlet is blocked; and said supply pressure being of a magnitude and said flow restriction being of a size that said needle valve member moves cyclically between said closed position and said open position, wherein said needle valve member reciprocates numerous times to spray a plurality of spray pulses within one engine cycle.

2. The fuel injection system of claim 1 wherein said needle valve member has a lifting hydraulic surface exposed to fuel pressure in an area between said nozzle outlet and said flow restriction.

3. The fuel injection system of claim 1 wherein said needle valve member is biased toward said closed position but movable toward said open position when fuel pressure surrounding said needle valve member is above a valve opening pressure; and said supply pressure is about equal to said valve opening pressure.

4. The fuel injection system of claim 1 wherein said fuel has a viscosity; and at least one of said supply pressure and said size of said flow restriction being a function of said viscosity.

5. The fuel injection system of claim 1 further comprising a flow restriction valve positioned in said nozzle supply passage; and movement of said flow restriction valve changes said size of said flow restriction.

6. The fuel injection system of claim 1 wherein said needle valve member includes a closing hydraulic surface exposed to fluid pressure in a needle control chamber defined by said injector body; and a needle control valve attached to said injector body and being movable between an on position in which said needle control chamber is open to a low pressure passage, and an off position in which said needle control chamber is open to a source of high pressure.

7. The fuel injection system of claim 1 further comprising a hydraulic check damper operably connected to said needle valve member.

8. The fuel injection system of claim 1 further comprising a pressure regulator connected to said source of fuel.

9. A fuel infection system comprising:

a injector body defining a nozzle outlet with an outlet flow area connected to a nozzle supply passage having a flow restriction with a restricted flow area about equal to said outlet flow area a source of fuel at a supply pressure in fluid communication with said nozzle supply passage;

a needle valve member having an lifting hydraulic surface positioned in said injector body and being movable between an open position in which said nozzle outlet is open, and a closed position in which said nozzle outlet is blocked;

a spring operably positioned to bias said needle valve member toward said closed position, and said spring at least partially defining a valve opening pressure; and said supply pressure being of a magnitude and said flow restriction being of a size that said needle valve member moves cyclically between said closed position and said open position, wherein said needle valve member reciprocates numerous times to spray a plurality of spray pulses within one engine cycle.

10. The fuel injection system of claim 9 further comprising a pressure regulator connected to said source of fuel.

11. The fuel injection system of claim 10 wherein said fuel has a viscosity; and at least one of said supply pressure and said size of said flow restriction being a function of said viscosity.

12. The fuel injection system of claim 11 further comprising a flow restriction valve positioned in said nozzle supply passage; and movement of said flow restriction valve changes said size of said flow restriction.

13. The fuel injection system of claim 12 wherein said needle valve member includes a closing hydraulic surface exposed to fluid pressure in a needle control chamber defined by said injector body; and a needle control valve attached to said injector body and being movable between an on position in which said needle control chamber is open to a low pressure passage, and an off position in which said needle control chamber is open to a source of high pressure.

14. The fuel injection system of claim 13 further comprising a hydraulic check damper operably connected to said needle valve member.

15. A method of fuel injection comprising the steps of:

providing a fuel injector having an injector body defining a nozzle outlet connected to a nozzle supply passage having a flow restriction, wherein said nozzle outlet has an outlet flow area and said flow restriction has a restricted flow area;

connecting the nozzle supply passage to a source of fuel that is at a supply pressure;

positioning a movable needle valve member in said injector body; and adjusting said supply pressure to a magnitude and said flow restriction to a size that cause said needle valve member to move cyclically between a closed position and an open position in part by setting said outlet flow area to be about equal to said restricted flow area, wherein said needle valve member reciprocates numerous times to spray a plurality of spray pulses within one engine cycle.

16. The method of claim 15 wherein said fuel has a viscosity; and said magnitude of said supply pressure and said size of said flow restriction are adjusted as a function of said viscosity.

17. The method of claim 15 wherein said needle valve member is biased toward a closed position but movable toward an open position when fuel pressure surrounding said needle valve member is above a valve opening pressure; and said adjusting step includes setting said supply pressure to be about equal to said valve opening pressure.

* * * * *